US007805102B2

(12) United States Patent
Kato

(10) Patent No.: US 7,805,102 B2
(45) Date of Patent: Sep. 28, 2010

(54) HEATING DEVICE AND IMAGE FORMATION APPARATUS

(75) Inventor: Wataru Kato, Joso (JP)

(73) Assignee: Canon Finetech Inc., Joso-shi, Ibaraki (JP)

( * ) Notice: Subject to any disclaimer, the term of this patent is extended or adjusted under 35 U.S.C. 154(b) by 119 days.

(21) Appl. No.: 11/999,444

(22) Filed: Dec. 4, 2007

(65) Prior Publication Data

US 2008/0187372 A1 Aug. 7, 2008

(30) Foreign Application Priority Data

Dec. 8, 2006 (JP) ..... 2006-331509

(51) Int. Cl.
*G03G 15/20* (2006.01)

(52) U.S. Cl. ..... 399/329; 399/328; 399/324

(58) Field of Classification Search ..... 399/324, 399/325, 328, 329
See application file for complete search history.

(56) References Cited

U.S. PATENT DOCUMENTS 6,430,386 B2 * 8/2002 Okubo et al. ..... 399/328
6,456,819 B1 * 9/2002 Abe et al. ..... 399/329
7,027,763 B2 * 4/2006 Kato et al. ..... 399/329

* cited by examiner

*Primary Examiner*—Sandra L Brase
(74) *Attorney, Agent, or Firm*—Reed Smith LLP

(57) ABSTRACT

On a sliding surface of a heating support body positioned in a downstream side in a film body moving direction wherein the heating temperature is comparatively high and the fluidity of a lubricant agent is good, fluid guiding grooves which uniformly disperse the lubricant agent are provided, thereby well dispersing the lubricant agent over the entire region from a center region to both-end regions of the heating support body and the film body and maintaining good slidability of the film body over a long period of time.

6 Claims, 5 Drawing Sheets

HEATING DEVICE AND IMAGE FORMATION APPARATUS

TECHNICAL FIELD

The present invention relates to a heating device and an image formation apparatus configured to heat a heating target material with interposition of a film body pressure-contacted with a heating body.

BACKGROUND ART

Generally, a heating device having a structure in which a heating target material is pressure-contacted with an arbitrary heating body with interposition of a film body therebetween and the heating target material is moved with the film body and heated at the same time has been used in various apparatuses. For example, various image formation apparatuses such as a printer using an electrophotographic method, a copy machine, and a fax machine employ a heating fixing device of a contact heating type which performs fixation of unfixed toner images transferred from an image carrier such as a photoconductive drum to a recording material side. In the heating fixing device, a film heating fixation method in which the recording material is heated via a fixing film having a small thermal capacity from the viewpoint of recent power saving, and the like has been widely employed. According to the film heating fixation method, when the fixing film having a small thermal capacity and high thermal conduction efficiency is interposed between the heating body such as a heater and the recording material serving as a heating target material, the rise time of the apparatus can be shortened, and power consumption can be reduced.

In a heating fixing device employing such a film fixation method, as shown in FIG. 2 and FIG. 3 according to an embodiment of the present invention, a heating body 118*e* is attached to a part of a sliding surface (lower surface in the drawing) of a heating support member 118*d* so as to be exposed, and a pressure roller 118*b* is pressure-contacted with a heating surface (lower surface in the drawing) of the heating body 118*e* from the lower side of the drawing via a fixing film 118*a* which is circularly movably disposed. When rotary drive of the pressure roller 118*b* is performed, the fixing film 118*a* and a recording material P serving as a heating target material are dependently moved, and, at the same time, a heating fixation action of unfixed toner T on the recording material P is performed.

An arbitrary lubricant agent such as grease is applied on the inner surface side of the fixing film 118*a* so that the above described movement of the fixing film 118*a* is smoothly performed in this process. When the lubricant agent such as grease is interposed between the fixing film 118*a* and the sliding surface of the heating support member 118*d* and the heating surface of the heating body 118*e*, the slidability between the members is improved.

However, such a lubricant agent comprising grease or the like has a tendency that, along with heating and temperature increase, the viscosity thereof is lowered and the fluidity thereof is increased, and an appropriate pressure is applied when the recording material P serving as a heating target material is caused to pass therethrough. Therefore, along with elapse of usage time, sometimes, the lubricant agent is moved from a center region in a longitudinal direction (image formation width direction) orthogonal to the movement direction of the fixing film 118*a* toward outside regions, and the lubricant agent leaks to outside from both ends in the longitudinal direction of the fixing film 118*a*. The lubricant agent leaked to outside in this manner may be a cause of deterioration in image quality, for example, the lubricant agent adheres to the outer surface of the fixing film 118*a* and deteriorates the detachability of the recording material P, or the lubricant agent adheres to the surface of the recording material P and the adhesion mark thereof is formed as an image.

Particularly, when the recording material P having a narrow size is caused to continuously pass through the center region of the longitudinal direction (image formation width direction) of the heating body, the temperature of the both-end regions, which are non-passage regions, is increased than the temperature of the center region, which is the passage region of the recording material P. The lubricant agent of the both-end regions (non-passage parts) of which fluidity is increased along with the temperature increase often leaks to outside from the both end portions of the longitudinal direction of the fixing film 118*a*. As a result, the amount of the lubricant agent in the both-end regions is reduced, and unevenness is caused in the distribution of the retention amount of the lubricant agent between the center region and the both-end regions. In the both-end regions in which the amount of the lubricant agent is reduced, the slidability between the fixing film 118*a* and the heating body 118*e* is deteriorated, thereby damaging the inner surface of the fixing film 118*a* and generating abnormal noise, and the reduction in the amount of the lubricant agent sometimes leads to shortened life of the equipment.

In order to solve such problems, for example in a heating device disclosed in Japanese Patent Application No. 1997-101695, a plurality of bosses or grooves are provided in an upstream side of a heating body, thereby preventing oozing of grease (lubricant agent) from both-end portions of a fixing film. However, in this device, the bosses or grooves are disposed in a region in which the heating temperature is comparatively low and fluidity of the lubricant agent is not good, in other words, in upstream side of the fixing film movement direction; therefore, the lubricant agent cannot be sufficiently spread in the longitudinal direction, a tendency that the lubricant agent is concentrated in a center region is generated, and friction of the fixing film with respect to the bosses or grooves is large.

Moreover, since the above described fixing film is pressure-contacted with a rotating pressure roller and rotated in a dependent manner, the fixing film has a tendency that it is strongly pulled toward the portion pressure-contacted with the pressure roller. Therefore, when the plurality of bosses or grooves are provided in the upstream side of the heating body like above described preceding literature, the inner surface of the fixing film strongly abuts edges of grooves on the surface of a heating support body; thus, there is a possibility that, for example, the inner surface of the fixing film is damaged, and the life of the fixing film is shortened.

Therefore, it is an object of the present invention to provide a heating device and an image formation apparatus capable of lengthening the life of equipment by facilitating spreading of a lubricant agent in the direction orthogonal to a film body movement direction of a fixing film or the like and eliminating lubricant agent leakage and capable of preventing generation of abnormal noise due to contamination or lubricant agent shortage due to lubricant agent leakage by a simple structure.

SUMMARY OF THE INVENTION

A heating device according to the present invention for achieving the above described object has a structure which heats a heating target material pressure-contacted, via a film body, with a sliding surface of a heating support member and a heating surface of a heating body, which is disposed to be exposed in part of the sliding surface of the heating support member, while moving the heating target material together with the film body and has an arbitrary lubricant agent interposed between the sliding surface of the heating support member and the heating surface of the heating body and the film body; wherein a fluid guiding groove approximately uniformly guiding the lubricant agent is provided on the sliding surface of the heating support member; and the fluid guiding groove is provided in a downstream side of a pressure-bonding part of the film body and the heating target material with respect to a moving direction of the film body.

According to a heating device according to the present invention having such a structure, on the sliding surface of the heating support member positioned in a downstream side in the film body moving direction where the heating temperature is comparatively high and the fluidity of the lubricant agent is increased, the fluid guiding groove which uniformly guides and spreads the lubricant agent is provided. Therefore, the lubricant agent is well dispersed and uniformly spread over the entire region from the both-end regions to the center region of the heating support member and the film body, thereby well maintaining the slidability of the film body over a long period of time.

Particularly, since the fixing film discharged from the pressure-contacted part with a pressure roller is moved in a manner that it is sent out, it is not strongly pulled by the pressure roller. Therefore, the edge of the fluid guiding groove and the inner surface of the fixing film do not strongly abut each other, and the life of the fixing film is not shortened due to damaged inner surface of the fixing film like conventional cases.

As described above, according to the present invention, by a simple structure, uniform spreading of the lubricant agent in the direction orthogonal to the film body moving direction is facilitated, the life of the apparatus can be elongated by eliminating lubricant agent leakage, generation of abnormal noise due to contamination due to lubricant agent leakage or lubricant agent shortage can be prevented, and the reliability of the heating device and image formation apparatus can be significantly improved with low cost.

In the heating device according to the present invention, when a structure in which a plurality of the fluid guiding grooves are formed in a direction orthogonal to the moving direction of the film body, and each of the fluid guiding grooves is extended in the direction inclined with respect to the moving direction of the film body is employed, the above described spreading action of the lubricant agent is reliably performed.

In the heating device according to the present invention, when a structure in which the inclination angles of the plurality of fluid guiding grooves are set to be mutually different or a structure in which the inclination angles of the plurality of fluid guiding grooves are successively increased and varied in the direction orthogonal to the moving direction is employed, the fluid guiding grooves are formed so as to have the inclination angles corresponding to the temperature distribution in the longitudinal direction, in other words, the level of the fluidity of the lubricant agent, thereby more reliably maintaining the uniform dispersibility of the lubricant agent.

In the heating device according to the present invention, when a structure in which disposition intervals of the plurality of fluid guiding grooves are successively varied in the direction orthogonal to the moving direction of the film body or a structure in which the inclination angles and disposition intervals of the plurality of fluid guiding grooves are set to be mutually different in a center-side region and end-side region in the direction orthogonal to the moving direction of the film body is employed, the fluid guiding grooves are formed so as to have disposition intervals corresponding to the temperature distribution in the longitudinal direction, in other words, the level of the fluidity of the lubricant agent, thereby more reliably maintaining the uniform dispersibility of the lubricant agent.

In the heating device according to the present invention, when a structure in which a bottom surface portion of the fluid guiding groove is formed to be a curved surface is employed, spreading of the lubricant agent is more smoothly performed.

Furthermore, since an image formation apparatus according to the present invention has the heating device described in any of the above descriptions as a fixing device, similar actions can be implemented in the image formation apparatus.

DESCRIPTION OF PREFERRED EMBODIMENTS

Hereinafter, embodiments in which the present invention is applied to a heating fixing device of a copy machine will be described in detail based on drawings. First of all, as shown in FIG. 1, a whole structure of a copy machine serving as an image formation apparatus will be described.

Figure 1:
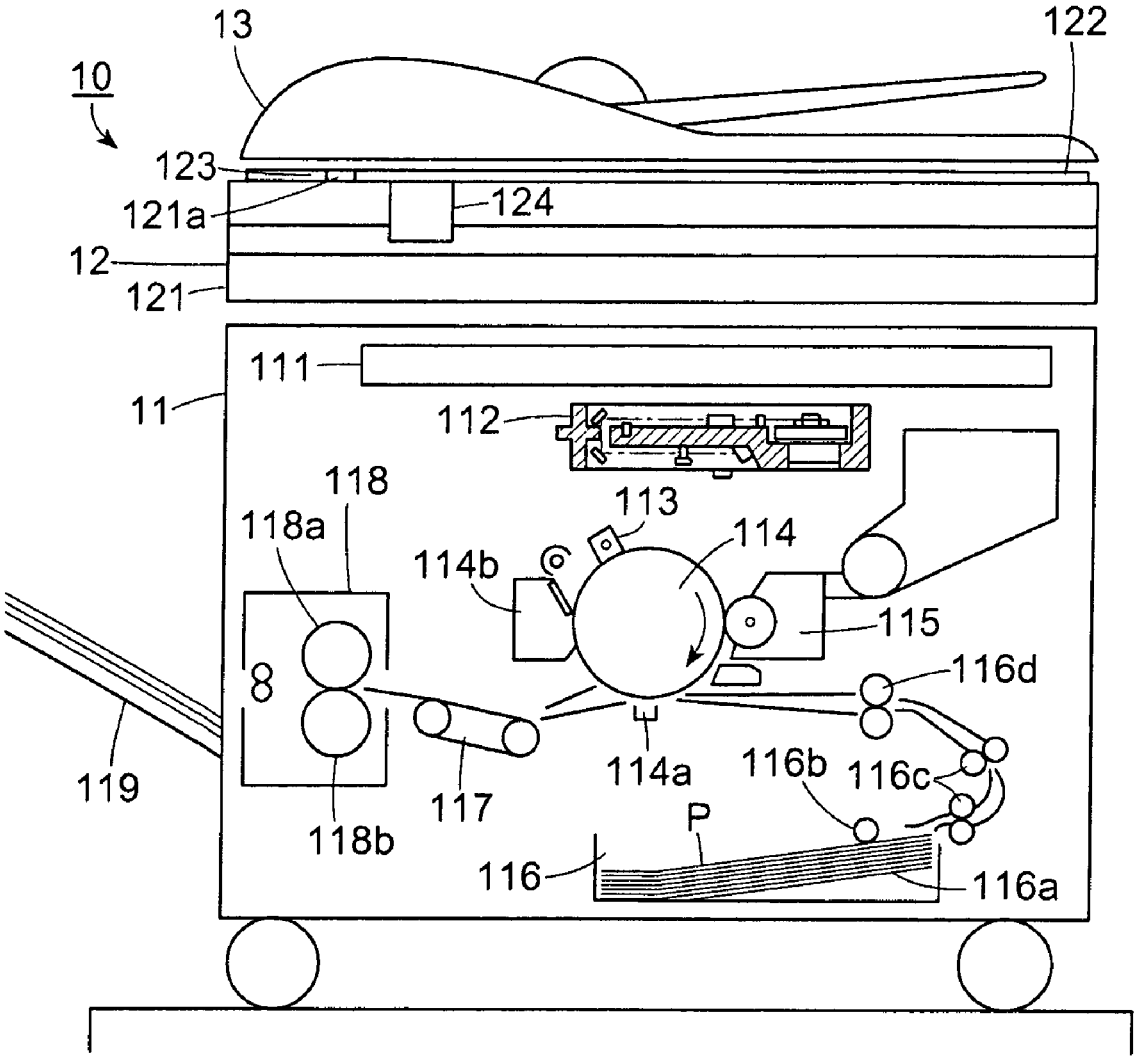
FIG. 1 is a vertical cross-section explanatory diagram showing an entire structure of a copy machine as an example of an image formation apparatus to which the present invention is applied.

The entirety of a copy machine 10 shown in FIG. 1 has a printer unit (apparatus main body unit) 11 which performs image formation operations with respect to recording sheets P serving as heating target materials, an image reading device 12 set at an upper position of the printer unit 11, and an automatic document feeding device (ADF) 13 which automatically feeds documents to the image reading device 12.

When image information of documents read by the image reading device 12 is input to a controller 111 disposed in the printer unit (apparatus main body unit) 11, it is fed to a laser beam scanner 112 as image signals. A scanning beam emitted from the laser beam scanner 112 irradiates a photoconductive drum 114, which is driven to rotate in the direction of an arrow in the drawing while it is uniformly electrically charged in advance by a primary electrical charging device 113, and an electrostatic latent image is formed on the surface of the photoconductive drum 114. The electrostatic latent image formed on the surface of the photoconductive drum 114 becomes a toner image which is developed when toner serving as a developer adheres thereto when passing through a developing device 115.

Meanwhile, in a sheet feeding cassette 116 disposed below the photoconductive drum 114, many recording sheets P serving as recording materials are stored so as to be loaded on a center plate 116*a*. The recording sheet P sent from the sheet feeding cassette 116 by rotary drive of a sheet feeding roller 116*b* is passed to a transporting roller pair 116*c* and sent to a resist roller pair 116*d*.

The resist roller pair 116*d* is disposed so as to receive the distal end of the recording sheet P in the state in which rotation is stopped and corrects the inclination of the recording sheet P so as to cause it to be in a straight state by forming arbitrary flexure in the recording sheet P. Then, when rotation of the resist roller pair 116*d* is started in coordination with the timing of the rotation of the photoconductive drum 114, the recording sheet P is sent to a transfer region between a transferring device 114*a* and the photoconductive drum 114 so that the distal end thereof is adjusted with a toner image on the photoconductive drum 114, and the recording sheet P is electrically charged by transfer bias imparted from the transferring device 114*a*, thereby transferring the toner image in the photoconductive drum 114-side to the recording sheet P.

A transporting belt 117 extending from the transfer region toward the rear side (left side in the drawing) is disposed so as to send the recording sheet P, onto which the toner image has been transferred in the above described manner, to a heating fixing device 118. In the heating fixing device 118, as specifically shown in FIG. 2, the fixing film 118*a* serving as a film body constituting a part of the heating body is provided, and the pressure roller 118*b* is disposed so as to be pressure-contacted with the lower surface side of the fixing film 118*a* in the drawing by an arbitrary biasing means such as a spring, which is not shown in the drawing. Then, the recording sheet (recording material) P serving as a heating target body is caused to pass through a fixation nip region formed in the pressure bonding part between the fixing film (heating body) 118*a* and the pressure roller 118*b*, and a heating fixation process with respect to the unfixed toner image on the recording sheet P is performed by a heating/pressurizing action imparted in the fixation nip region.

Returning to FIG. 1, the recording sheet P, on which a permanent image is formed by the above described heating fixation action, is discharged onto a discharge tray 119 having a wing plate-like shape. The remaining toner remaining on the surface of the photoconductive drum 114 after transfer is removed by a remaining toner scraping-off action of a cleaner 114*b*.

Figure 3:
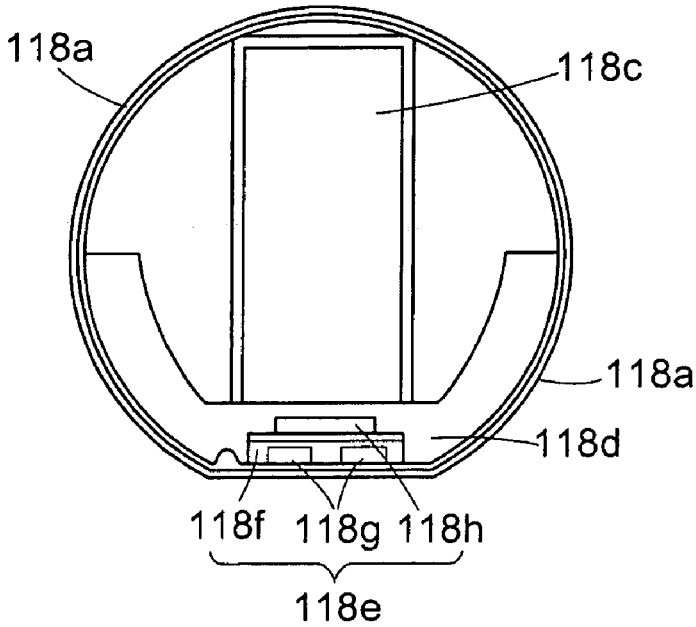
FIG. 3 is a vertical cross sectional explanatory diagram schematically showing a structure of a heating body and a fixing film according to an embodiment of the present invention used in the heating fixing device shown in FIG. 2.

As particularly shown in FIG. 3, the fixing film (film body) 118*a* provided in the above described heating fixing device 118 is supported so as to be circularly slidable along the outer peripheral surface of the film guide 118*d* constituting a heating support member attached to a pressure stay 118*c* having rigidity/heat resistance. At a part of a sliding surface formed in the lower surface side, in the drawing, of the film guide 118*d*, a heating surface of a ceramic heater 118*e* having a narrow long plate-like shape is attached so as to be exposed in the lower side.

The ceramic heater 118*e* constitutes the heating body which applies heat necessary for a fixation process to the fixation nip region formed in the pressure-contacted part of the pressure roller 118*b* and the fixing film 118*a*, and it is disposed in the disposition relation that the inner peripheral surface of the fixing film 118*a* is slidably in close contact with the heating surface of the lower surface side, in the drawing, of the ceramic heater 118*e*.

The fixing film 118*a* in the present embodiment is formed of a material having a small thermal capacity such as polyimide, polyamide, PEEK, PES, PPS, PFA, PTFE, or FEP having heat resistance and thermal plasticity. In order to ensure offset prevention and separative performance of the recording material, the surface layer of the fixing film 118*a* is covered by a mixture or any one of heat resistance resins having good detachability such as PFA, PTFE, and FEP.

Figure 2:
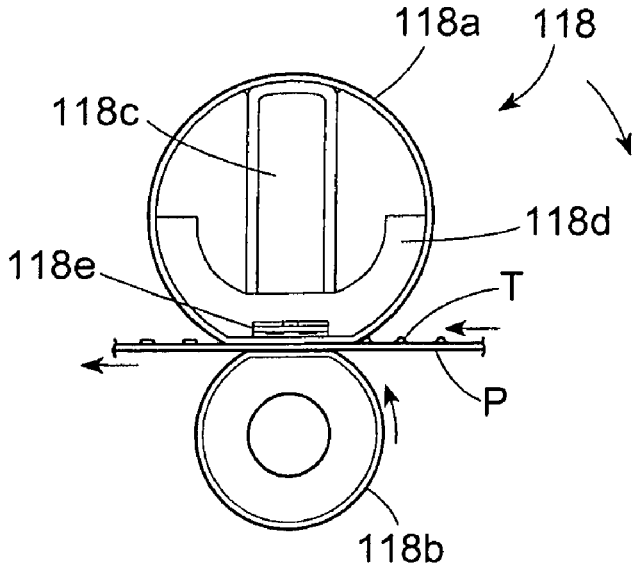
FIG. 2 is a vertical cross sectional explanatory diagram schematically showing the structure of a heating fixing device provided in the copy machine shown in FIG. 1.

The film guide 118*d* serving as the heating support member is formed of, for example, liquid crystal polymer, phenol resin, PPS, or PEEK, has the ceramic heater 118*e* at a lower end part as described above, is composed as a heat insulating member which prevents heat dissipation to the direction opposite to the nip region, and has a shape and size so that the above described fixing film 118*a* can rotate in the direction of an arrow in FIG. 2 with allowance.

Furthermore, as the above described ceramic heater 118*e*, a heater of a so-called tensionless type disclosed in, for example, Japanese Patent Application Laid-Open (kokai) No. 1992-44075 to 44083, Japanese Patent Application Laid-Open (kokai) No. 1992-204980 to 204984 is employed; wherein a heater substrate 118*f* which is extended in a thin long shape along the longitudinal direction orthogonal to the transporting direction (moving direction) of the recording sheet P and has heat resistance, insulating property, and good thermal conductivity, and resistance heating bodies 118*g* are disposed along the longitudinal direction (image formation width direction) of the heater substrate 118*f*. The ceramic heater 118*e* is heated when power for heating is fed from power-feeding electrodes (not shown in the drawing) disposed at both-end portions of the longitudinal direction of the resistance heating bodies 118*g*. The heating temperature in this process is detected by a thermistor (thermometry device) 118*h* disposed at a part immediately above the ceramic heater substrate 118*f*.

Meanwhile, in a roller employed as the above described pressure roller 118*b*, in the outer peripheral side of a cored bar composed of a metal member of aluminum or the like, a primer layer is formed via an elastic layer formed of heat-resisting rubber such as silicon rubber or fluorine rubber or foam or the like of silicon rubber, and, in the surface layer thereof, a detachment layer formed of a tube of PFA, PTFE, FEP, or the like is formed is employed. The above described primer layer is formed to have electrical conductivity and is composed so that the surface thereof is negatively electrically charged through friction when highly resistive paper such as dry paper passes through; thus, toner repels the friction electrical charge, thereby preventing generation of electrostatic offset in which the toner adheres the fixing film 118*a* side again.

The pressure roller 118*b* having such a structure is configured to be rotated and driven by a drive means including an arbitrary fixing motor driven and controlled by an engine controller (fixing drive control means), of which illustration is omitted. The roller is also configured so that the fixing film 118*a* is moved while it is circularly slid following the rotary drive of the pressure roller 118*b*, and the recording sheet (heating target material) P introduced into the fixation nip region is transported (moved) while the sheet is pressed in the state in which it is in close contact with the fixing film 118*a*. When the recording sheet P is transported in the fixation nip region in this manner, an unfixed toner image T supported on the recording sheet P is subjected to a fixation process by the heat from the above described ceramic heater 118*e* and a nip pressure by the pressure roller 118*b*.

Since the fixing film 118*a* performs rotary movement while sliding on the heating surface of the ceramic heater (heating body) 118*e* disposed in the inner side thereof and the sliding surface of the film guide (heating support body) 118*d* as described above, the friction resistance between the heating surface of the ceramic heater 118*e* and the sliding surface of the film guide 118*d* and the inner peripheral surface of the fixing film 118*a* has to be suppressed to be small. Therefore, at the part where the fixing film 118*a* is in close contact with the heating surface of the ceramic heater 118*e* and the sliding surface of the film guide 118*d*, a small amount of a lubricant agent such as heat resistive grease for maintaining good following drive performance and sliding performance of the fixing film 118*a* is interposed, thereby enabling smooth rotary movement of the fixing film 118*a*.

Figure 4:
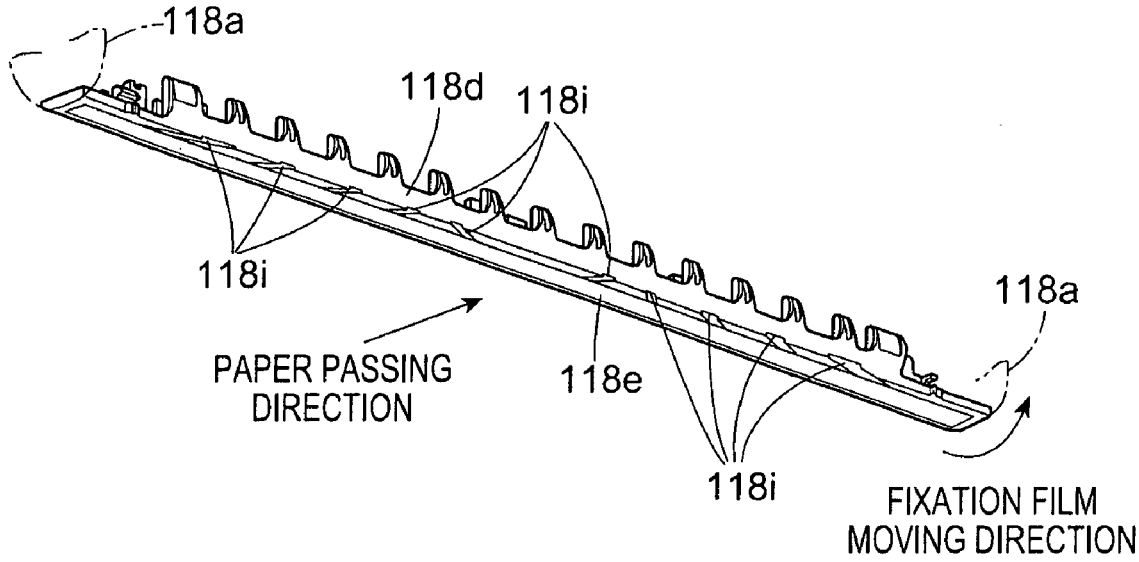
FIG. 4 is an appearance perspective explanatory diagram showing a structure of a heating-side surface of a heating support body according to the embodiment of the present invention shown in FIG. 3.
Figure 5:
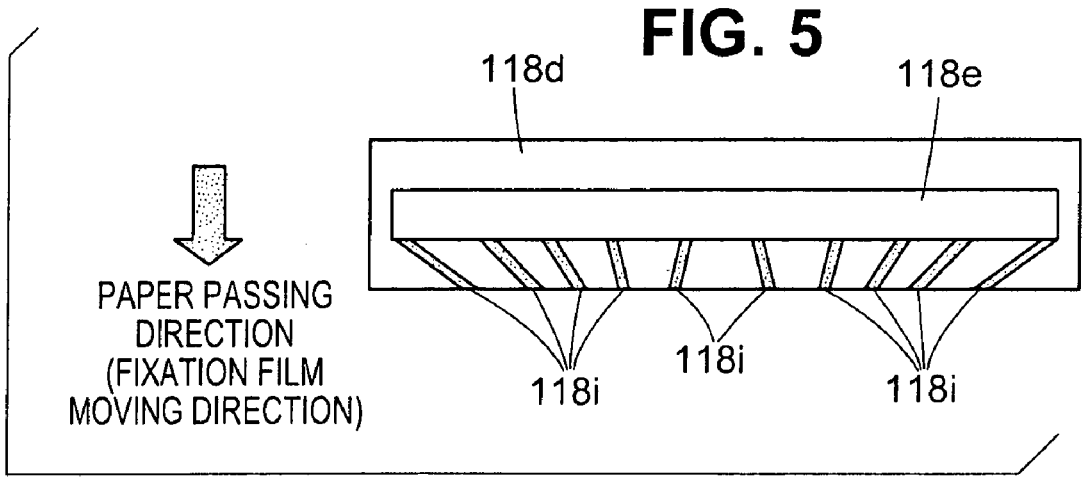
FIG. 5 is a bottom-surface explanatory diagram showing a structure of the heating-side surface of the heating support body according to the embodiment of the present invention shown in FIG. 4.

Corresponding to the lubricant agent such as heat resistive grease interposed in this manner, on the sliding surface (lower surface of FIG. 3) of the film guide 118*d* serving as the heating support member, as particularly shown in FIG. 4 and FIG. 5, a plurality of fluid guiding grooves 118*i* for spreading the lubricant agent are formed in the longitudinal direction (image formation width direction) of the film guide 118*d*.

The fluid guiding grooves 118*i* are formed on the surface positioned in the downstream side of the fixation nip region (pressure-contacted part) relative to the moving direction (downward direction in FIG. 5) of the fixing film 118*a* in the sliding surface (lower surface in FIG. 3) of the film guide (heating support member) 118*d*, are extended from the downstream side edge of the ceramic heater 118*e* in the moving direction of the fixing film 118*a*, and are disposed so that the space therefrom to the downstream side edge of the sliding surface of the film guide 118*d* is communicated. The bottom surface part of the fluid guiding groove 118*i* is formed to have a transverse cross sectional shape of a concave shape, for example, an approximately semicircular shape, composed of a smooth curved line so that the fluidity of the lubricant agent is improved.

Each of the above described fluid guiding grooves 118*i* is formed to linearly extend so as to form an arbitrary inclination angle with respect to the moving direction (downward direction in FIG. 5) of the fixing film 118*a*. The inclination angles of the fluid guiding grooves 118*i* are set to be successively varied along the longitudinal direction (image formation width direction) of the film guide (heating support member) 118*d* which is the direction orthogonal to the moving direction (downward direction in FIG. 5) of the fixing film 118*a*.

More specifically, among the above described plurality of fluid guiding grooves 118*i*, each pair of the center fluid guiding grooves 118*i* approximately symmetrically disposed in a centermost region in the image formation width direction orthogonal to the moving direction of the fixing film 118*a* is set so as to form inclination angles directed toward the moving direction (downward direction in FIG. 5) of the fixing film 118*a* and open to the outer side of the image formation width direction (longitudinal direction of the film guide 118*d*), thereby causing the lubricant agent present in the center-side region to flow toward the regions in the outer side (end side). The plural pairs of the outer fluid guiding grooves 118*i* disposed in the outer side of the pair of the center fluid guiding grooves 118*i* are set so as to form inclination angles directed toward the moving direction (downward direction in FIG. 5) of the fixing film 118*a* and closed toward the inner side of the image formation width direction (longitudinal direction of the film guide 118*d*), thereby causing the lubricant agent, which has the tendency that it moves from the region in the center side to the regions in the outer side, to flow in the direction returning toward the center region.

Furthermore, the inclination angles of the above described outer fluid guiding grooves 118*i* are set to be mutually different; and, in the directions directed from the center-side region of the longitudinal direction (image formation width direction) orthogonal to the moving direction (downward direction of FIG. 5) of the fixing film 118*a* toward the regions in the outer side, the inclination angles of the above described outer fluid guiding grooves 118*i* are set to vary so as to successively increase. The fluid guiding groove 118*i* disposed at an outermost position in the longitudinal direction (image formation width direction) forms a steepest angle from an outermost end position of the ceramic heater 118*e* and extends to a lowermost stream end (lowest edge in FIG. 5) in the sliding surface (lower surface in FIG. 3) of the film guide (heating support member) 118*d*. The fluid guiding grooves 118*i* having above described structures have, as a whole, a function of approximately uniformly spreading the lubricant agent along the longitudinal direction (image formation width direction).

As a specific embodiment of the above described fluid guiding grooves 118*i*, grooves having a width of 5 mm and a depth of 1 mm are used, and the inclination angles of, in total, ten fluid guiding grooves 118*i* are set 45°, 60°, 75°, and 105° respectively in the order from the center side.

According to the heating device according to the present embodiment having such a structure, the fluid guiding grooves 118*i* which uniformly disperses the lubricant agent are disposed on the sliding surface of the film guide (heating support member) 118*d* positioned in the lower stream side in the moving direction of the fixing film 118*a* where the heating temperature is comparatively high and the fluidity of the lubricant agent is good; therefore, the lubricant agent is well spread and uniformly dispersed over the entire region from the center region in the longitudinal direction of the film guide 118*d* and the fixing film 118*a* to the both-end regions, and the slidability of the fixing film 118*a* is well maintained over a long period of time.

Figure 6:
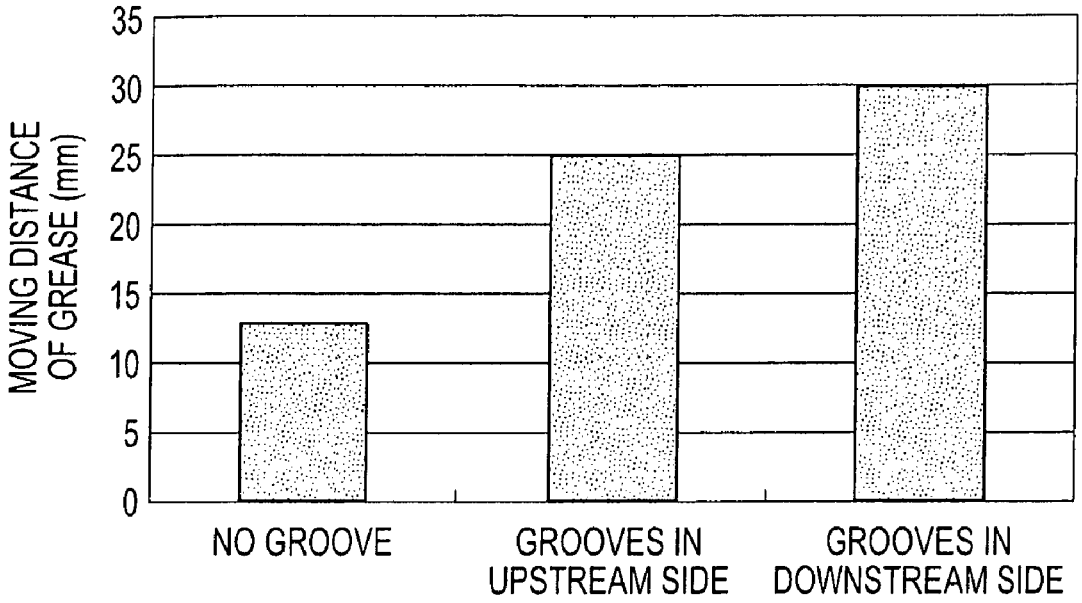
FIG. 6 is a line diagram showing results of checking the moving distances of grease applied on end portions of the heating support body for each of structures of fluid guiding grooves.
Figure 7:
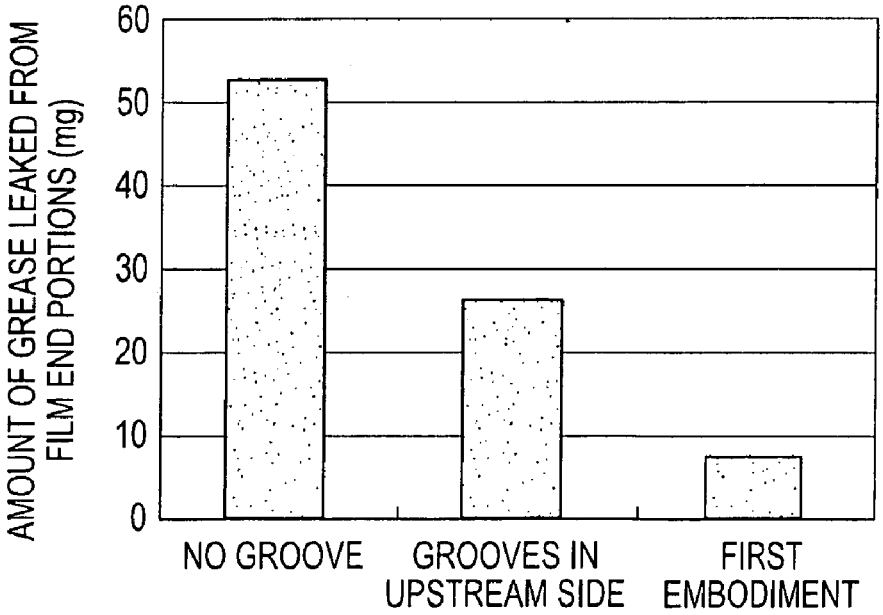
FIG. 7 is a line diagram showing results of checking the amount of grease leaked from the end portions of the heating support body for each of the structures of the fluid guiding grooves.

When the uniform dispersibility of the grease in the case in which the present embodiment is used is actually checked, for example, improvements as shown in FIG. 6 and FIG. 7 have been observed. More specifically, first of all, FIG. 6 shows the results of checking the moving distances (vertical axis) of the grease to the center side when 5000 sheets of paper recording materials having an A3 size are caused to pass through in this state in the state in which 300 mg of the grease is applied at positions 8.5 mm from both end positions in the longitudinal direction (image formation width direction) of the fixing film 118*a*. When the fluid guiding grooves 118*i* are provided on the sliding surface in the lower stream side of the film guide (heating support member) 118*d* like the above described present embodiment (the case in which grooves in the lower stream side), a moving distance of about 30 mm was observed. On the other hand, when fluid guiding grooves are provided in the upstream side of the sliding surface of the film guide 118*d* (the case in which grooves are in the upstream side), the moving distance is reduced to about 25 mm. Furthermore, the moving distance in the case in which no fluid guiding groove is provided (case without grooves) is reduced to about 13 mm.

Therefore, it can be understood that the groove guiding function of moving the lubricant agent is more improved in the case in which the fluid guiding grooves 118*i* are provided on the downstream side sliding surface of the film guide (heating support member) 118*d* like the present embodiment compared with the case in which no fluid guiding groove is provided and the case in which the fluid guiding grooves are disposed in the upstream side.

Furthermore, FIG. 7 shows the results of checking the amount of the grease (vertical axis) leaked from one end part in the longitudinal direction of the fixing film 118*a* when 5000 sheets of paper recording materials having an A3 size are caused to pass through in the state in which 800 mg of the grease is uniformly applied on the heating surface of the above described ceramic heater (heating body) 118*e*. A leakage amount of merely about 8 mg is observed when the fluid guiding grooves 118*i* are provided on the downstream side sliding surface of the film guide (heating support member) 118*d* like the above described present embodiment. On the other hand, the grease leakage amount is increased to 27 mg when the fluid guiding grooves are provided in the upstream side of the sliding surface of the film guide 118*d* (the case in which grooves are in the upstream side). Furthermore, the grease leakage amount is increased to 53 mg when no fluid guiding groove is provided (case without groove).

Therefore, it can be understood that end leakage from the fixing film 118*a* can be significantly reduced more in the case in which the fluid guiding grooves 118*i* are provided on the downstream side sliding surface of the film guide (heating support member) 118*d* as described in the present embodiment compared with the case in which no fluid guiding groove is provided and the case in which the fluid guiding grooves are disposed in the upstream side.

Herein, particularly in the present embodiment, a plurality of the fluid guiding grooves 118*i* provided on the sliding surface of the film guide (heating support member) 118*d* are formed in the longitudinal direction (image formation width direction), each of the fluid guiding grooves 118*i* extends in the direction inclined with respect to the moving direction of the fixing film 118*a*, the inclination angles of the plurality of guiding grooves 118*i* are mutually different and successively vary in the longitudinal direction (image formation width direction), and the bottom surface part of the fluid guiding groove 118*i* is formed to be a curved shape; therefore, the above described uniform dispersibility action of the lubricant agent is reliably performed.

Figure 8:
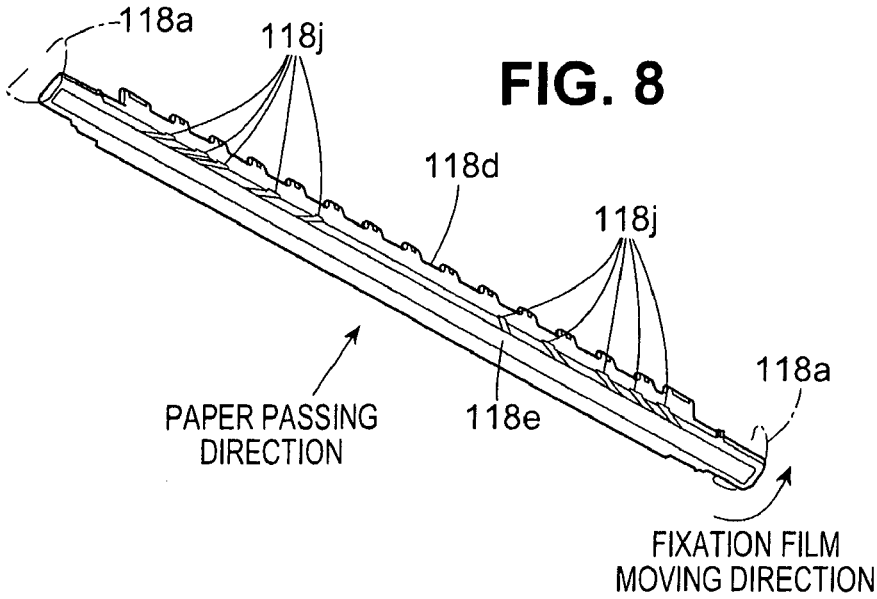
FIG. 8 is an appearance perspective explanatory diagram showing a structure of a heating-side surface of a heating support body according to another embodiment of the present invention.
Figure 9:
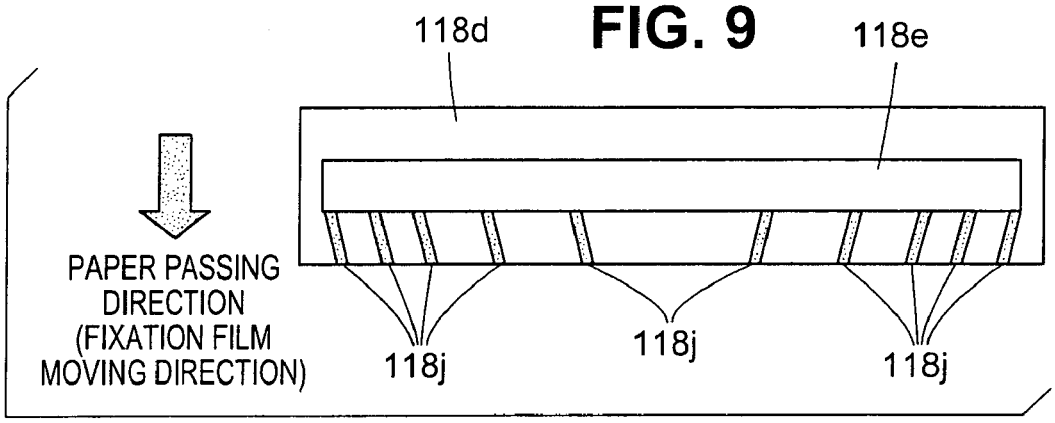
FIG. 9 is a bottom surface explanatory diagram showing a structure of the heating-side surface of the heating support body according to the other embodiment of the present invention shown in FIG. 8.

Next, fluid guiding grooves 118*j* in a second embodiment shown in FIG. 8 and FIG. 9 are disposed on the sliding surface positioned in the downstream side more than the ceramic heater 118*e* like the above described first embodiment and provided so as to incline and extend in the direction directed from outer-side regions toward the center-side region in the longitudinal direction (image formation width direction) orthogonal to the moving direction (downward direction in FIG. 9) of the fixing film 118*a*. The disposition intervals between the adjacent fluid guiding grooves 118*j* are set to be mutually different. The disposition intervals are set so as to be successively reduced in the directions directed from the center-side region of the longitudinal direction (image formation width direction) toward the outer-side regions.

The reason that the disposition intervals between the adjacent fluid guiding grooves 118*j* are narrow in the outer regions is that recording materials sometimes do not pass through the outer regions. In the outer-side regions through which the recording materials do not pass, the temperature is increased, the viscosity of the lubricant agent is reduced, and the fluidity of the lubricant agent is increased since heat is not taken by recording materials. When the fluid guiding grooves 118*j* as many as possible are provided in such outer region, the function of approximately uniformly dispersing the lubricant agent in the longitudinal direction (image formation width direction) as a whole by the fluid guiding grooves 118*j* even when recording materials having a small size are caused to continuously pass through is imparted.

As a specific embodiment of the fluid guiding grooves 118*j* in this case, grooves having a width of 5 mm, a depth of 1 mm, and an inclination angle of 45° are used, and the disposition intervals of, in total, ten fluid guiding grooves 118*j* are 0 mm, 11 mm, 26 mm, 65 mm, 104 mm, 226 mm, 275 mm, 304 mm, 319 mm, and 330 mm, respectively in order from the outermost end part.

When generation of abnormal noise is actually checked in an apparatus according to such second embodiment, an improvement as shown in a following table 1 has been observed. Specifically, the following table 1 shows the results of checking the presence of generation of abnormal noise when 5000 sheets of recording materials having a postcard size are caused to pass through in the state in which 100 mg of grease is uniformly applied on the sliding surface of the above described film guide (heating support member) 118*d*.

TABLE 1

| | GROOVES | | |
|---|---|---|---|
| | NO GROOVE | IN UPSTREAM SIDE | SECOND EMBODIMENT |
| NUMBER OF ABNORMAL-SOUND-GENERATED SHEETS | 400 SHEETS | 768 SHEETS | NO GENERATION EVEN WHEN 100 SHEETS ARE PASSED THROUGH |

According to the table 1, when the fluid guiding grooves 118*j* are provided on the downstream side sliding surface of the film guide 118*d* like the above described second embodiment (the case in which grooves are in downstream side), abnormal noise was not generated until 1000 sheets were passed through. On the other hand, when the fluid guiding grooves are provided in the upstream side of the sliding surface of the film guide 118*d* (the case in which grooves are in upstream side), abnormal noise was generated when 768 sheets were passed through. Furthermore, when no fluid guiding groove was provided (case without groove), abnormal noise was generated when 400 sheets were passed through.

Therefore, it has been found out that generation of abnormal noise is reduced more in the case in which the fluid guiding grooves 118*j* are provided on the downstream side sliding surface of the film guide (heating support member) 118*d* like the present embodiment compared with the case in which no fluid guiding groove is provided and the case in which the fluid guiding grooves are provided in the upstream side since the lubricant agent is uniformly dispersed even when recording materials having a small size are caused to pass through.

Figure 10:
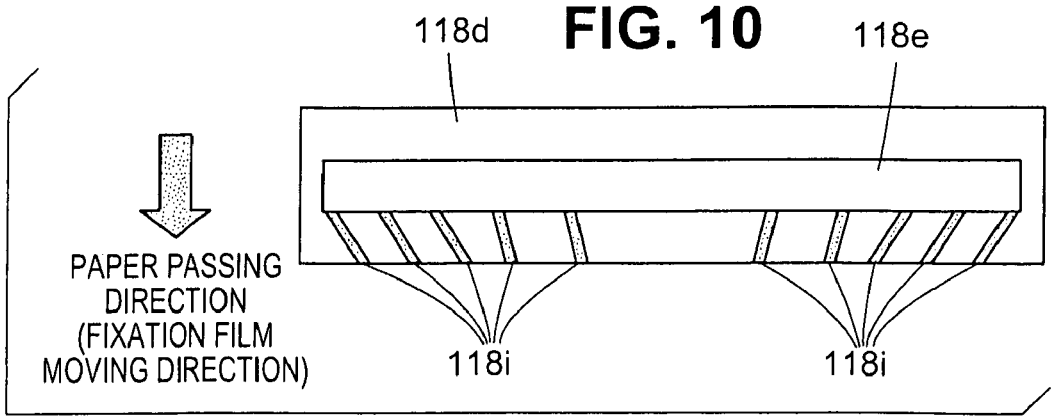
FIG. 10 is a bottom surface explanatory diagram showing a structure of a heating-side surface of a heating support body according to further another embodiment of the present invention.

Even when the disposition intervals of the plurality of fluid guiding grooves 118*j* are not successively varied in the direction orthogonal to the moving direction of the fixing film 118*a* like the above described embodiment, good results can be obtained as long as the disposition intervals of the fluid guiding grooves 118*j* are mutually different in a center-side region and an outer-side region in the same direction. Particularly, significantly good results can be obtained when the disposition interval in the center-side region is set to be wide, the disposition interval in the outside regions are set to be narrow, and the outer side ones are more inclined than the center-side ones regarding the inclination angles so that they are different, as shown in FIG. 10.

The embodiments of the invention accomplished by the present inventor have been described in detail hereinabove. However, the present invention is not limited to the above described embodiments, and it goes without saying that various modifications can be made without departing from the spirit thereof.

For example, the present invention is applied to a copy machine in the above described embodiments; however, the present invention can be widely applied in a heating device employed in various types of image formation apparatuses such as a copy machine and a fax machine.

The invention claimed is:

1. A heating device comprising a structure which heats a heating target material pressure-contacted, via a film body, with a sliding surface of a heating support member and a heating surface of a heating body, which is disposed to be exposed in part of the sliding surface of the heating support member, while moving the heating target material together with the film body and having an arbitrary lubricant agent interposed between (A) the sliding surface of the heating support member and the heating surface of the heating body and (B) the film body;

wherein a groove approximately uniformly guiding the lubricant agent is provided on the sliding surface of the heating support member; and wherein a plurality of the grooves are formed in a direction orthogonal to the moving direction of the film body, in such a manner that each of the grooves is provided so as to be inclined and extended with respect to the moving direction of the film body; and wherein the inclination angles of the plurality of grooves are set to be mutually different.

2. A heating device comprising a structure which heats a heating target material pressure-contacted, via a film body, with a sliding surface of a heating support member and a heating surface of a heating body, which is disposed to be exposed in part of the sliding surface of the heating support member, while moving the heating target material together with the film body and having an arbitrary lubricant agent interposed between (A) the sliding surface of the heating support member and the heating surface of the heating body and (B) the film body;

wherein a groove approximately uniformly guiding the lubricant agent is provided on the sliding surface of the heating support member; and wherein a plurality of the grooves are formed in a direction orthogonal to the moving direction of the film body, in such a manner that each of the grooves is provided so as to be inclined and extended with respect to the moving direction of the film body; and wherein the inclination angles of the plurality of grooves are successively varied in the direction orthogonal to the moving direction of the film body.

3. A heating device comprising a structure which heats a heating target material pressure-contacted, via a film body, with a sliding surface of a heating support member and a heating surface of a heating body, which is disposed to be exposed in part of the sliding surface of the heating support member, while moving the heating target material together with the film body and having an arbitrary lubricant agent interposed between (A) the sliding surface of the heating support member and the heating surface of the heating body and (B) the film body;

wherein a groove approximately uniformly guiding the lubricant agent is provided on the sliding surface of the heating support member; and wherein a plurality of the grooves are formed in a direction orthogonal to the moving direction of the film body, in such a manner that each of the grooves is provided so as to be inclined and extended with respect to the moving direction of the film body; and wherein disposition intervals of the plurality of grooves are successively varied in the direction orthogonal to the moving direction of the film body.

4. A heating device comprising a structure which heats a heating target material pressure-contacted, via a film body, with a sliding surface of a heating support member and a heating surface of a heating body, which is disposed to be exposed in part of the sliding, surface of the heating support member, while moving the heating target material together with the film body and having an arbitrary lubricant agent interposed between (A) the sliding surface of the heating support member and the heating surface of the heating body and (B) the film body;

wherein a groove approximately uniformly guiding the lubricant agent is provided on the sliding surface of the heating support member; and wherein a plurality of the grooves are formed in a direction orthogonal to the moving direction of the film body, in such a manner that each of the grooves is provided so as to be inclined and extended with respect to the moving direction of the film body; and wherein the inclination angles or disposition intervals of the plurality of grooves are set to be different in a center-side region and outer-side region in the direction orthogonal to the moving direction of the film body.

5. A heating device comprising a structure which heats a heating target material pressure-contacted, via a film body, with a sliding surface of a heating support member and a heating surface of a heating body, which is disposed to be exposed in part of the sliding surface of the heating support member, while moving the heating target material together with the film body and having an arbitrary lubricant agent interposed between (A) the sliding surface of the heating support member and the heating surface of the heating body and (B) the film body;

wherein a groove approximately uniformly guiding the lubricant agent is provided on the sliding surface of the heating support member; and wherein a plurality of the grooves are formed in a direction orthogonal to the moving direction of the film body, in such a manner that each of the grooves is provided so as to be inclined and extended with respect to the moving direction of the film body; and wherein the inclination angles of the plurality of grooves are different in the direction orthogonal to the moving direction of the film body.

6. An image formation apparatus having the heating device according to any one of claims 1 to 5 as a fixing device.

* * * * *